US012607366B2

(12) United States Patent
Zhou et al.

(10) Patent No.: US 12,607,366 B2
(45) Date of Patent: Apr. 21, 2026

(54) WALL-MOUNTED AIR CONDITIONER

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Baisong Zhou, Foshan (CN); Duode Wu, Foshan (CN); Bo Li, Foshan (CN); Yongqiang Wan, Foshan (CN); Qiqin Su, Foshan (CN); Yunchong Tu, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 122 days.

(21) Appl. No.: 18/563,874

(22) PCT Filed: Feb. 11, 2022

(86) PCT No.: PCT/CN2022/076096
§ 371 (c)(1),
(2) Date: Nov. 23, 2023

(87) PCT Pub. No.: WO2022/252685
PCT Pub. Date: Dec. 8, 2022

(65) Prior Publication Data

US 2024/0263809 A1 Aug. 8, 2024

(30) Foreign Application Priority Data

Jun. 1, 2021 (CN) ..... 202110611186.4

(51) Int. Cl.
*F24F 1/0314* (2019.01)
*F24F 1/0323* (2019.01)
(Continued)

(52) U.S. Cl.
CPC ..... *F24F 1/0314* (2019.02); *F24F 1/0323* (2019.02); *F24F 11/89* (2018.01); *F24F 13/222* (2013.01)

(58) Field of Classification Search
CPC ..... F24F 1/0314; F24F 1/0323; F24F 1/0057; F24F 1/0063; F24F 11/89; F24F 13/222; F24F 2221/17
See application file for complete search history.

(56) References Cited

U.S. PATENT DOCUMENTS

2008/0120989 A1* 5/2008 Tanaka ..... F24F 1/0063 96/63
2020/0340687 A1 10/2020 Zhu et al.

FOREIGN PATENT DOCUMENTS

CN 103868149 A 6/2014
CN 104848420 A 8/2015
(Continued)

OTHER PUBLICATIONS

Machine Translation JP 2014016131 (Year: 2014).*
(Continued)

*Primary Examiner* — Joseph F Trpisovsky
(74) *Attorney, Agent, or Firm* — K&L Gates LLP

(57) ABSTRACT

Provided is a wall-mounted air conditioner. The wall-mounted air conditioner includes a casing, an electric control component and a heat exchanger, and the casing is internally provided with an air duct; the air duct is provided with an air inlet and an air outlet; the air duct includes an air intake section and an air output section, which are connected to each other; at least a part of the air inlet is positioned on
(Continued)

the front face of the casing; a mounting space is formed between a front panel of the casing and the air duct; the mounting space is positioned at the front portion of an interior space of the casing and close to a lower portion; the heat exchanger is arranged in the air duct; and the electric control component is arranged in the mounting space.

12 Claims, 4 Drawing Sheets

(51) Int. Cl.
*F24F 11/89* (2018.01)
*F24F 13/22* (2006.01)

(56) References Cited

FOREIGN PATENT DOCUMENTS

| | | | |
|---|---|---|---|
| CN | 104864499 | A | 8/2015 |
| CN | 205090547 | U | 3/2016 |
| CN | 210441336 | U | 5/2020 |
| CN | 215372681 | U | 12/2021 |
| JP | H08110085 | A | 4/1996 |
| JP | H094869 | A | 1/1997 |
| JP | H10311552 | A | 11/1998 |
| JP | 2000035228 | A | 2/2000 |
| JP | 2001065916 | A | 3/2001 |
| JP | 2002156134 | A | 5/2002 |
| JP | 2002156135 | A | 5/2002 |
| JP | 2004084973 | A | 3/2004 |
| JP | 2010145057 | A | 7/2010 |
| JP | 2014016131 | A | 1/2014 |
| JP | 2014052183 | A | 3/2014 |
| JP | 2014081150 | A | 5/2014 |
| KR | 19980021338 | U | 7/1998 |
| KR | 20090022103 | A | 3/2009 |
| WO | 0116531 | A1 | 3/2001 |
| WO | 2021017207 | A1 | 2/2021 |

OTHER PUBLICATIONS

ISR received in PCT application PCT/CN2022/076096; mailed Apr. 20, 2022.
Search Report received in EP application 22814734.4; mailed May 22, 2024.
First OA received in CN application 202110611186.4; mailed May 31, 2024.
Second OA received in CN Application No. 202110611186.4; mailed Oct. 31, 2024.
JP OA Received in Application No. 2023-565290; mailed Oct. 22, 2024.
The Request for the Submission of an Opinion received in the counterpart KR Application No. 10-2023-7037375, dated Nov. 25, 2025, 8 pages with English translation.

* cited by examiner

WALL-MOUNTED AIR CONDITIONER

CROSS-REFERENCES TO RELATED APPLICATIONS

The present disclosure is a national phase application of International Application No. PCT/CN2022/076096, filed Feb. 11, 2022, which claims priority to and benefits of Chinese Patent Application No. 202110611186.4, filed on Jun. 1, 2021, the entire content of which is incorporated herein by reference.

FIELD

This application relates to the field of air conditioners, and more particularly to a wall-mounted air conditioner.

BACKGROUND

In the related art, an air inlet of a wall-mounted air conditioner is at its top. In order to meet a requirement for air inflow from the top, the wall-mounted air conditioner has to be at a large distance from an indoor top wall, resulting in low indoor space utilization and making the indoor space more cramped. In one embodiment, the wall-mounted air conditioner in the related art has low heat exchange efficiency.

SUMMARY

The present disclosure aims to solve at least one of the problems existing in the related art. Accordingly, embodiments of the present disclosure propose a wall-mounted air conditioner.

The wall-mounted air conditioner according to embodiments of the present disclosure includes: a housing, an electric control component, and a heat exchanger. An air duct is arranged in the housing, has an air inlet and an air outlet, and includes an air inflow section and an air outflow section connected to each other. At least a part of the air inlet is on a front surface of the housing. A mounting space is defined between a front plate of the housing and the air duct and is in a front and lower position within an internal space of the housing. The heat exchanger is in the air duct, and the electric control component is in the mounting space.

According to the present disclosure, since at least a part of the air inlet of the wall-mounted air conditioner is on the front surface of the housing, ambient air (air inflow) can enter the air duct substantially from the front of the housing. For example, the ambient air (air inflow) can enter the air duct from the straight front of the housing, or from the top front of the housing, or from the bottom front of the housing. In addition, the ambient air can enter the air duct from at least two directions selected from the straight front of the housing, the top front of the housing, or from the bottom front of the housing.

That is, the ambient air does not necessarily enter the air duct directly above the housing. In such a way, a distance between the wall-mounted air conditioner and an indoor top wall can be greatly decreased or even eliminated, and the utilization rate of indoor space can be improved, especially for indoor space (rooms) with lower heights, which can effectively reduce or eliminate a cramped sense of the indoor space.

Therefore, the wall-mounted air conditioner according to embodiments of the present disclosure has a very low requirement for mounting space. As long as the wall-mounted air conditioner can be accommodated in the mounting space, there is no need to leave an air inflow space above the wall-mounted air conditioner, which can expand the applicability of the wall-mounted air conditioner.

In some embodiments, the air inlet is located on the front surface, inclined upwards towards the wall surface (which can be understood as a mounting surface) relative to a vertical surface. In this way, when a user standing on the ground of the room, the user cannot see the interior of the housing (the wall-mounted air conditioner) through the air inlet, and internal structures of the housing (the wall-mounted air conditioner) are not exposed to the user, which can improve the user's visual comfort.

In one embodiment, in a scenario of air inflow from the top, the top space is often restricted and relatively narrow, which limits the air inflow volume due to the narrow top space. In the embodiments of this application, since at least a part of the air inlet is located on the front surface of the housing, the air entering the air duct through the air inlet can directly flow through the heat exchanger for sufficient heat exchange with the heat exchanger. That is, the air inflow volume of the wall-mounted air conditioner is not limited by the narrow space at the top. The air inflow from the front surface of the housing can effectively increase the air inflow volume and significantly increase the air flow volume through the heat exchanger, greatly enhancing the heat exchange efficiency of the heat exchanger.

In the present disclosure, since at least a part of the air inlet is located on the front surface of the housing, there is no need to mount a roughly inverted V-shaped heat exchanger below the air inlet, and it is unnecessary to mount a water receiving tray with a width greater than or equal to a width of the roughly inverted V-shaped heat exchanger at a lower end of the heat exchanger, to avoid failure in heat exchange of air with a part of the heat exchanger due to the part being obstructed by the water receiving tray. Since at least a part of the air inlet is located on the front surface of the housing, the water receiving tray will not prevent airflow from flowing to the heat exchanger. For example, the water receiving tray does not pass an airflow path to the heat exchanger, which can greatly improve the heat exchange efficiency of the heat exchanger. In one embodiment, the water receiving tray is located below the heat exchanger.

Therefore, the wall-mounted air conditioner in the embodiments of the present disclosure has advantages of easy installation, improved indoor space utilization, wide applicability, and high heat exchange efficiency.

In addition, the wall-mounted air conditioner in the embodiments of the present disclosure defines the mounting space in the front and lower position within the internal space of the housing, and the electric control component is mounted in this mounting space, and the electric control component does not occupy the space in the length direction of the air conditioner's body, which decreases the length of the air conditioner's body and improves the space utilization rate and integration of the wall-mounted air conditioner, making the structure of the wall-mounted air conditioner more compact and reasonable. In one embodiment, the electric control component will neither occupy the effective air inlet area of the heat exchanger, nor sacrifice the heat exchange efficiency of the heat exchanger, improving the performance of the wall-mounted air conditioner. In addition, since the mounting space is located behind the front plate of the housing, the user does not need to remove the entire housing when wiring, assembling/disassembling, testing, or repairing the electric control component. Instead, the user only needs to remove the front plate, which greatly improves the convenience for testing and maintenance and enhances operational comfort.

Therefore, the wall-mounted air conditioner according to the embodiments of the present disclosure has advantages of high utilization rate of the internal space, compact structure, small length, and convenience for testing and maintenance.

In some embodiments, the air inlet is on the front plate; the air inflow section extends horizontally or obliquely forwards from the air outflow section; a part, adjacent to the air outlet, of the air outflow section extends downwards and forwards from a remaining part of the air outflow section; and the mounting space is defined among the air inflow section, the air outflow section and the front plate.

In some embodiments, an air duct wall of the air inflow section includes a first air inflow plate and a second air inflow plate; an air duct wall of the air outflow section includes a first air outflow plate and a second air outflow plate; and the mounting space is defined among the second air inflow plate, the second air outflow plate and the front plate.

In some embodiments, the second air inflow plate includes a sunken part that forms a water receiving sink for receiving condensate water from the heat exchanger.

In some embodiments, the water receiving sink is on a first side of the sunken part, and the mounting space is on a second side of the sunken part.

In some embodiments, the wall-mounted air conditioner further includes a thermal insulation layer between the electric control component and the air duct.

In some embodiments, the electric control component includes: a protective shell including a box body and a box cover, the box body and the box cover being connected to form a sealed fireproof chamber; and an electrical component arranged in the fireproof chamber.

In some embodiments, the electrical component includes a mainboard and elements; the mainboard is parallel to a bottom plate of the box body, and there is a gap between the mainboard and the bottom plate; the elements are mounted on a surface of the mainboard away from the bottom plate.

In some embodiments, the front plate is a curved plate protruding forwards and includes an upper plate portion and a lower plate portion; the air inlet is on the upper plate portion; the mounting space is behind the lower plate portion; the bottom plate is obliquely arranged with a lower end of the bottom plate being behind an upper end of the bottom plate.

In some embodiments, the elements include a first group of elements and a second group of elements; the first group of elements has a height greater than a preset value; the second group of elements has a height less than or equal to the preset value; and a position of the second group of elements is higher than a position of the first group of elements.

In some embodiments, an intersection angle between a centerline of the air inflow section and a centerline of the air outflow section is greater than or equal to 10 degrees and less than or equal to 85 degrees.

Additional embodiments of the present disclosure will be given in part in the following descriptions, become apparent in part from the following descriptions, or be learned from the practice of the embodiments of the present disclosure.

Figure 1:
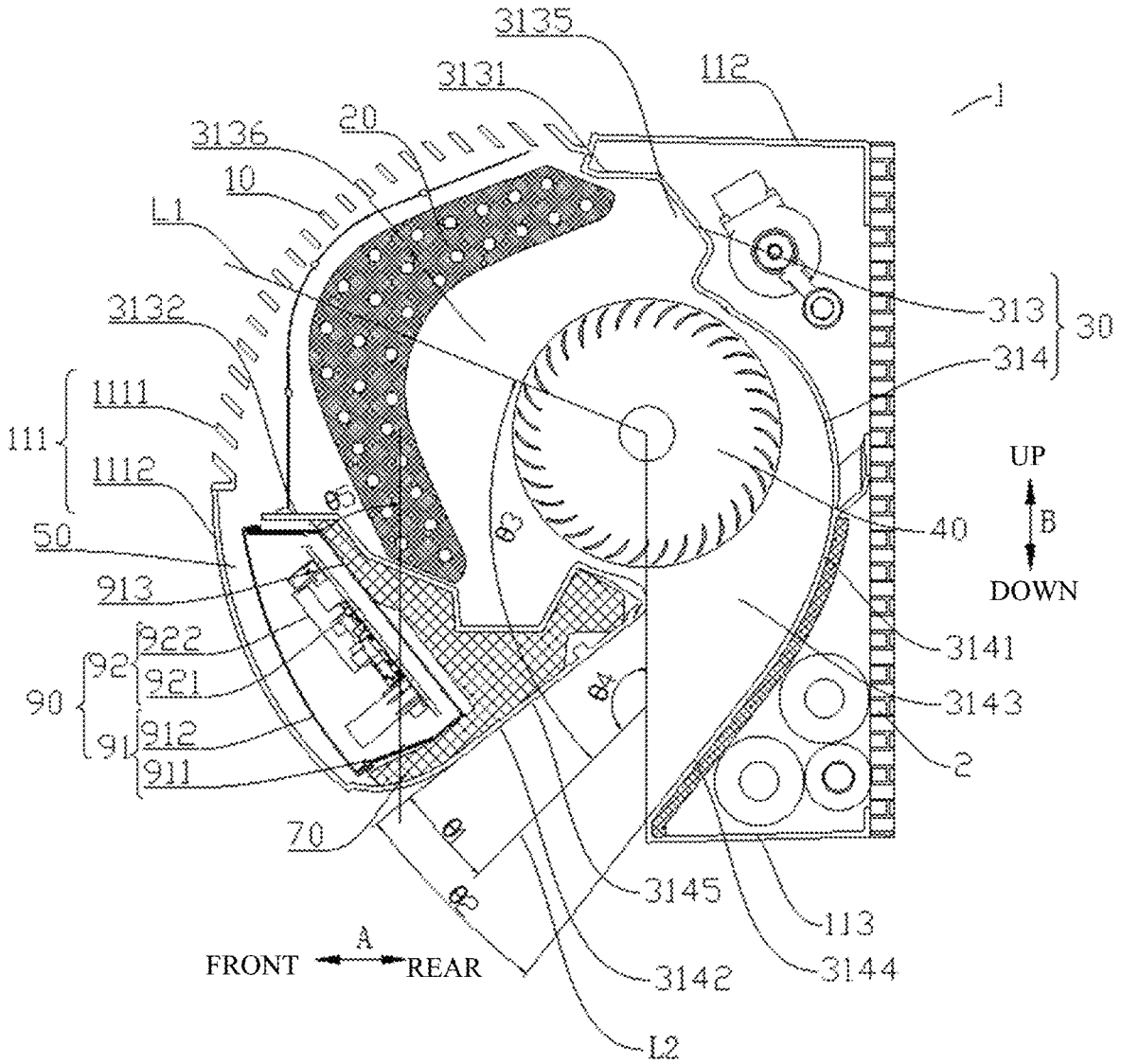
FIG. 1 is a sectional view of a wall-mounted air conditioner according to embodiments of the present disclosure.

REFERENCE NUMERALS wall-mounted air conditioner 1, wall surface 2, top wall 3, housing 10, front surface 11, front plate 111, rear surface 1110 of front plate 111, upper plate portion 1111, lower plate portion 1112, heat exchanger 20, air duct 30, air inlet 311, air outlet 312, air inflow section 313, first air inflow plate 3131, second air inflow plate 3132, side surface 31321, sunken part 3133, water receiving sink 3134, avoidance groove 3135, inlet air duct 3136, air outflow section 314, first air outflow plate 3141, second air outflow plate 3142, side surface 31421, outlet air duct 3143, first flat plate portion 3144, second flat plate portion 3145, fan wheel 40, mounting space 50, the water tank 60, thermal insulation layer 70, electric control component 90, protective shell 91, box body 911, box cover 912, bottom plate 913, electrical component 92, mainboard 921, element 922, centerline L1 of air inflow section, centerline L2 of air outflow section, intersection angle θ.

DETAILED DESCRIPTION OF THE DISCLOSURE

Embodiments of the present disclosure will be described in detail below, and examples of the embodiments will be shown in the accompanying drawings. The embodiments described below are exemplary and are intended to explain the present disclosure rather than limit the present disclosure.

The present disclosure is based on the inventors' discovery and understanding of the following facts and issues.

Figure 4:
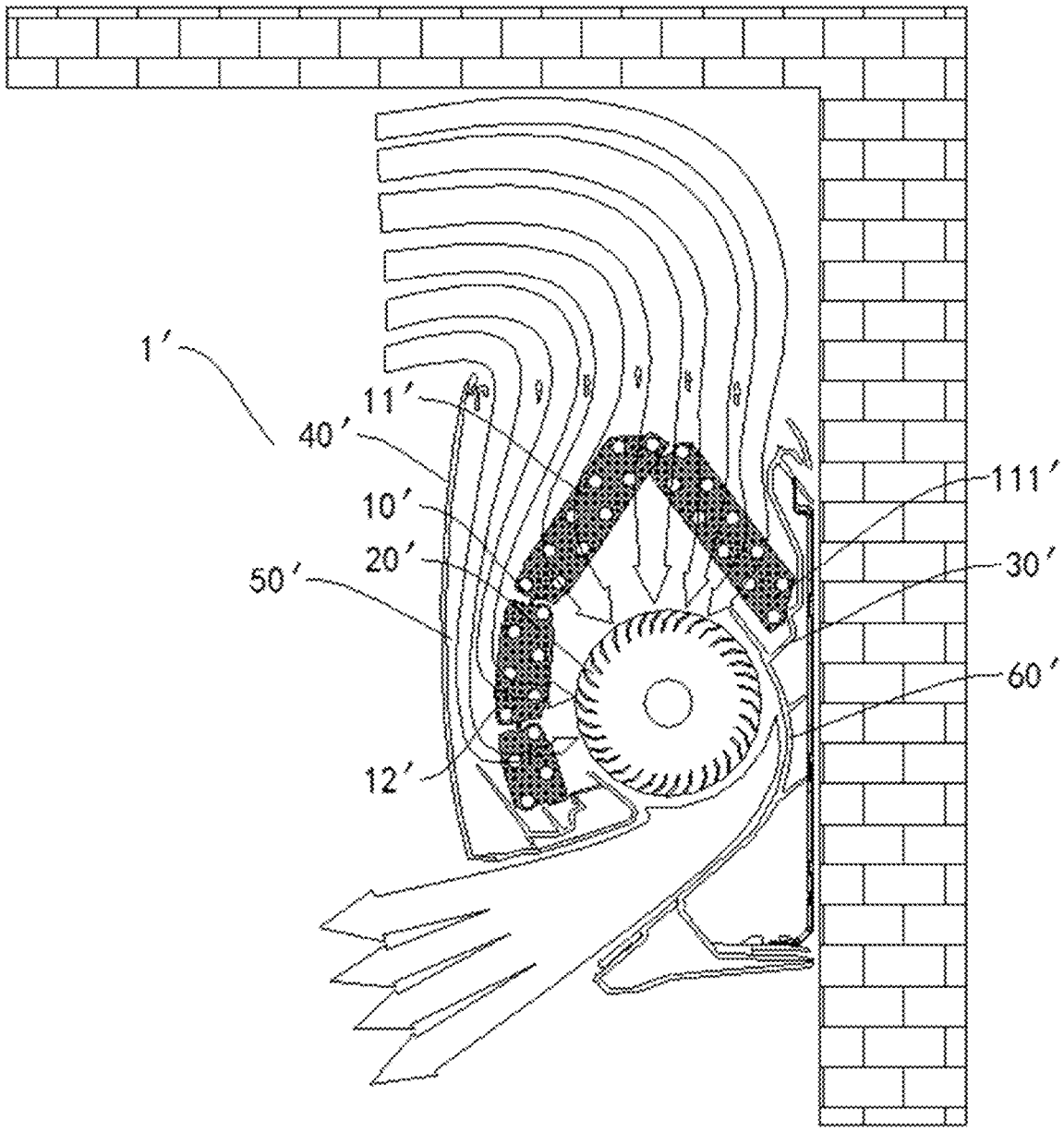
FIG. 4 is a sectional view of a wall-mounted air conditioner in the related art.

In the related art, as shown in FIG. 4, an air inlet of a wall-mounted air conditioner 1' is located at its top, and the top of the wall-mounted air conditioner 1' has to be at a large distance from an indoor top wall 3, to define an air inflow space. Consequently, the wall-mounted air conditioner 1' cannot be arranged tightly against the indoor top wall 3. A heat exchanger 10' of the wall-mounted air conditioner 1' is arranged around a cross-flow fan wheel 20'. In one embodiment, a first part 11' of the heat exchanger 10', which forms a roughly inverted V-shape, is located above the cross-flow fan wheel 20', and a second part 12' of the heat exchanger 10' is located in front of the cross-flow fan wheel 20'.

A water receiving tray 30' is provided below a rear lower end 111' of the first part 11'. The water receiving plate 30' is opposite to the rear lower end 111' of the first part 11' in an up-down direction and is located between the rear lower end 111' of the first part 11' and the cross-flow fan wheel 20'. The inventors have realized that the rear lower end 111' of the first part 11' is obstructed by the water receiving tray 30', and the rear lower end 111' of the first part 11' does not exchange heat with air, resulting in waste and lowering heat transfer efficiency.

An inlet air duct 50' is formed between the second part 12' and a front panel 40' of the wall-mounted air conditioner 1'. However, the inventors have realized that since most of the space in a front-rear direction of the wall-mounted air conditioner 1' is occupied by the heat exchanger 10', the cross-flow fan wheel 20' and a volute 60', the inlet air duct 50' is relatively narrow, resulting in a small air flow volume through the inlet air duct 50' and a low heat transfer efficiency of the second part 12'.

The inventors also find that an electric control component of the wall-mounted air conditioner in the related art is mounted on a side (e.g., a left side and/or a right side) of a length direction of the air conditioner's body. There are usually two situations: first, the electric control component is on the same side as a distributor and other pipeline systems; second, the electric control component and the pipeline systems such as the distributor are mounted on two sides of the length direction of the air conditioner's body respectively. However, regardless of the first situation or the second situation, the electric control component will occupy space along the length direction of the air conditioner's body, causing the air conditioner's body to be elongated. If the length of the air conditioner's body remains unchanged, the arrangement of the electric control component on the same side as the pipeline will reduce space for the pipeline and increase a risk of scratches and collisions with the pipeline. If the electric control component is mounted on a side of a length direction of the heat exchanger, it will occupy an effective air inlet area of the heat exchanger, to sacrifice the heat exchange efficiency of the heat exchanger. In one embodiment, when the electric control component is mounted on the side of the length direction of the air conditioner's body, a housing of the air conditioner has to be removed during maintenance and assembly/disassembly of the electric control component, increasing the difficulty of maintenance.

A wall-mounted air conditioner 1 according to embodiments of the present disclosure will be described below according to FIGS. 1 to 3. As shown in FIG. 1, the wall-mounted air conditioner 1 includes a housing 10, a heat exchanger 20, an air duct 30, and an electric control component 90. The air duct 30 is located inside the housing 10, and the heat exchanger 20 is located inside the air duct 30. The air duct 30 has an air inlet 311 and an air outlet 312, and the air duct 30 includes an air inflow section 313 and an air outflow section 314 connected to each other. The air inlet 311 is located in the air inflow section 313, and the air outlet 312 is located in the air outflow section 314.

At least a part of the air inlet 311 is located on a front surface 11 of the housing 10. The front surface 11 of the housing 10 is a surface that can be seen by a horizontal backward line of sight, that is, a surface of the housing 10 that can be seen by the horizontal backward line of sight is the front surface 11 of the housing 10. For example, when an observer's eyes are roughly at the same level as the housing 10 and the observer is in front of the housing 10, a surface of the housing 10 that the observer can see is the front surface 11 of the housing 10.

A front-rear direction is shown by arrow A in FIG. 1, and an up-down direction is shown by arrow B in FIG. 1. For example, the wall-mounted air conditioner 1 is mounted on a wall surface 2. A direction away from the wall surface 2 in the horizontal direction represents a forward direction, and a direction heading to the wall surface 2 in the horizontal direction represents a rearward direction.

There is a mounting space 50 between a front plate 111 of the housing 10 and the air duct 30. The electric control component 90 is within the mounting space 50. The mounting space 50 is in a front and lower position within an internal space of the housing 10, that is, the electric control component 90 is mounted in the front and lower position within the internal space of the housing 10.

According to the present disclosure, since at least a part of the air inlet of the wall-mounted air conditioner is on the front surface of the housing, ambient air (air inflow) can enter the air duct substantially from the front of the housing. For example, the ambient air (air inflow) can enter the air duct from the straight front of the housing, or from the top front of the housing, or from the bottom front of the housing. In addition, the ambient air can enter the air duct from at least two directions selected from the straight front of the housing, the top front of the housing, or from the bottom front of the housing.

That is, the ambient air does not necessarily enter the air duct directly above the housing. In such a way, a distance between the wall-mounted air conditioner and an indoor top wall can be greatly decreased or even eliminated, and the utilization rate of indoor space can be improved, especially for indoor space (rooms) with lower heights, which can effectively reduce or eliminate a cramped sense of the indoor space.

Therefore, the wall-mounted air conditioner according to embodiments of the present disclosure has a very low requirement for mounting space. As long as the wall-mounted air conditioner can be accommodated in the mounting space, there is no need to leave an air inflow space above the wall-mounted air conditioner, which can expand the applicability of the wall-mounted air conditioner.

In some embodiments, the air inlet 311 is located on the front surface, inclined upwards towards the wall surface 2 (which can be understood as a mounting surface) relative to a vertical surface. In this way, when a user standing on the ground of the room, the user cannot see the interior of the housing 10 (the wall-mounted air conditioner 1) through the air inlet 311, and internal structures of the housing 10 (the wall-mounted air conditioner 1) are not exposed to the user, which can improve the user's visual comfort.

In one embodiment, in a scenario of air inflow from the top, the top space is often restricted and relatively narrow, which limits the air inflow volume due to the narrow top space. In the embodiments of this application, since at least a part of the air inlet is located on the front surface of the housing, the air entering the air duct through the air inlet can directly flow through the heat exchanger for sufficient heat exchange with the heat exchanger. That is, the air inflow volume of the wall-mounted air conditioner is not limited by the narrow space at the top. The air inflow from the front surface of the housing can effectively increase the air inflow volume and significantly increase the air flow volume through the heat exchanger, greatly enhancing the heat exchange efficiency of the heat exchanger.

In the present disclosure, since at least a part of the air inlet is located on the front surface of the housing, there is no need to mount a roughly inverted V-shaped heat exchanger below the air inlet, and it is unnecessary to mount a water receiving tray with a width greater than or equal to a width of the roughly inverted V-shaped heat exchanger at a lower end of the heat exchanger, to avoid failure in heat exchange of air with a part of the heat exchanger due to the part being obstructed by the water receiving tray. Since at least a part of the air inlet is located on the front surface of the housing, the water receiving tray will not prevent airflow from flowing to the heat exchanger. For example, the water receiving tray does not pass an airflow path to the heat exchanger, which can greatly improve the heat exchange efficiency of the heat exchanger. In one embodiment, the water receiving tray is located below the heat exchanger.

Therefore, the wall-mounted air conditioner in the embodiments of the present disclosure has advantages of easy installation, improved indoor space utilization, wide applicability, and high heat exchange efficiency.

In addition, the wall-mounted air conditioner in the embodiments of the present disclosure defines the mounting space in the front and lower position within the internal space of the housing, and the electric control component is mounted in this mounting space, and the electric control component does not occupy the space in the length direction of the air conditioner's body, which decreases the length of the air conditioner's body and improves the space utilization rate and integration of the wall-mounted air conditioner, making the structure of the wall-mounted air conditioner more compact and reasonable. In one embodiment, the electric control component will neither occupy the effective air inlet area of the heat exchanger, nor sacrifice the heat exchange efficiency of the heat exchanger, improving the performance of the wall-mounted air conditioner. In addition, since the mounting space is located behind the front plate of the housing, the user does not need to remove the entire housing when wiring, assembling/disassembling, testing, or repairing the electric control component. Instead, the user only needs to remove the front plate, which greatly improves the convenience for testing and maintenance and enhances operational comfort.

Therefore, the wall-mounted air conditioner according to the embodiments of the present disclosure has advantages of high utilization rate of the internal space, compact structure, small length, and convenience for testing and maintenance.

Some embodiments according to the present disclosure will be described in detail below in conjunction with FIGS. 1 and 2. In some embodiments, the wall-mounted air conditioner 1 is mounted on the wall surface 2 indoors.

Figure 2:
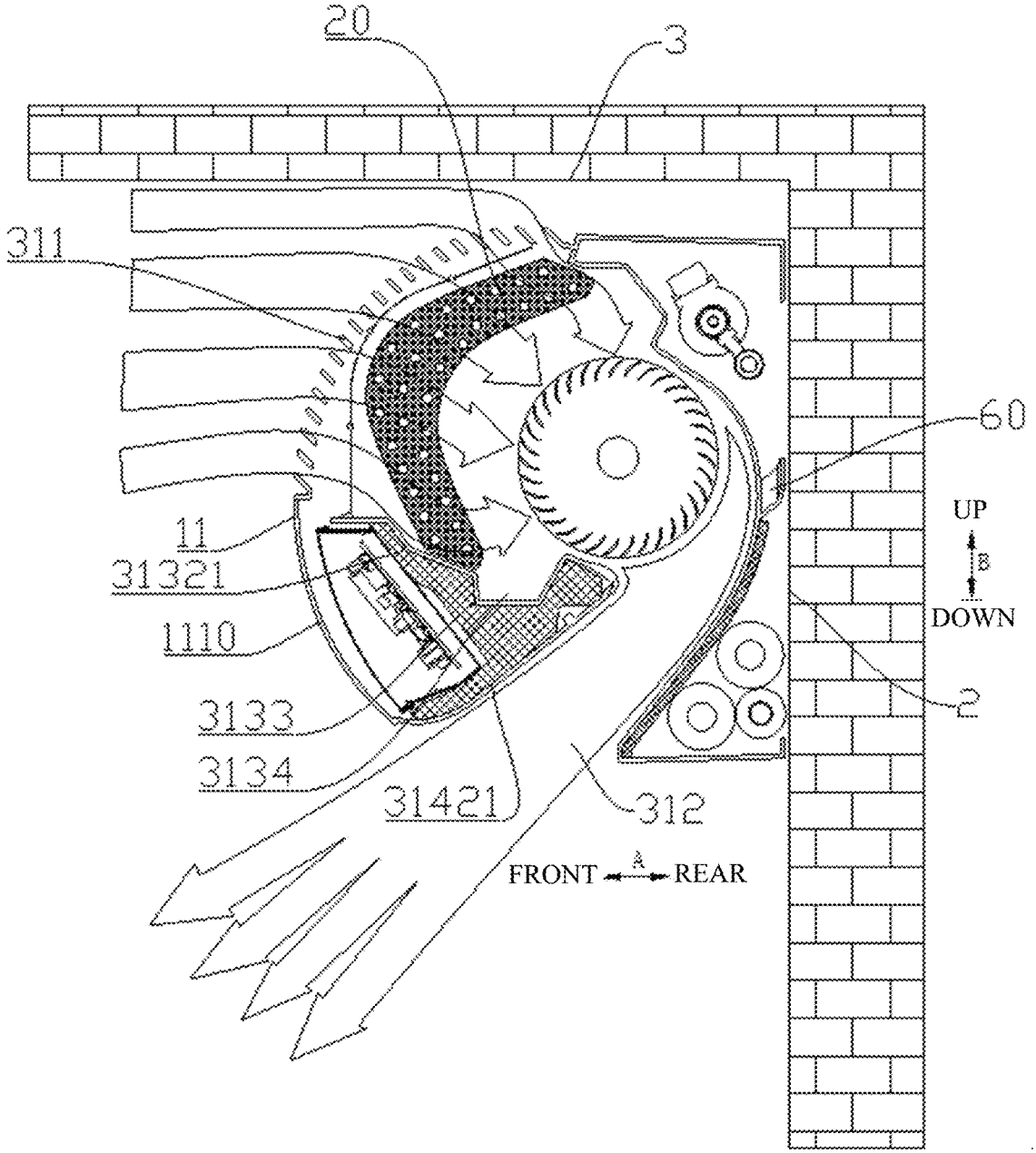
FIG. 2 is a sectional view of a wall-mounted air conditioner according to embodiments of the present disclosure.
Figure 3:
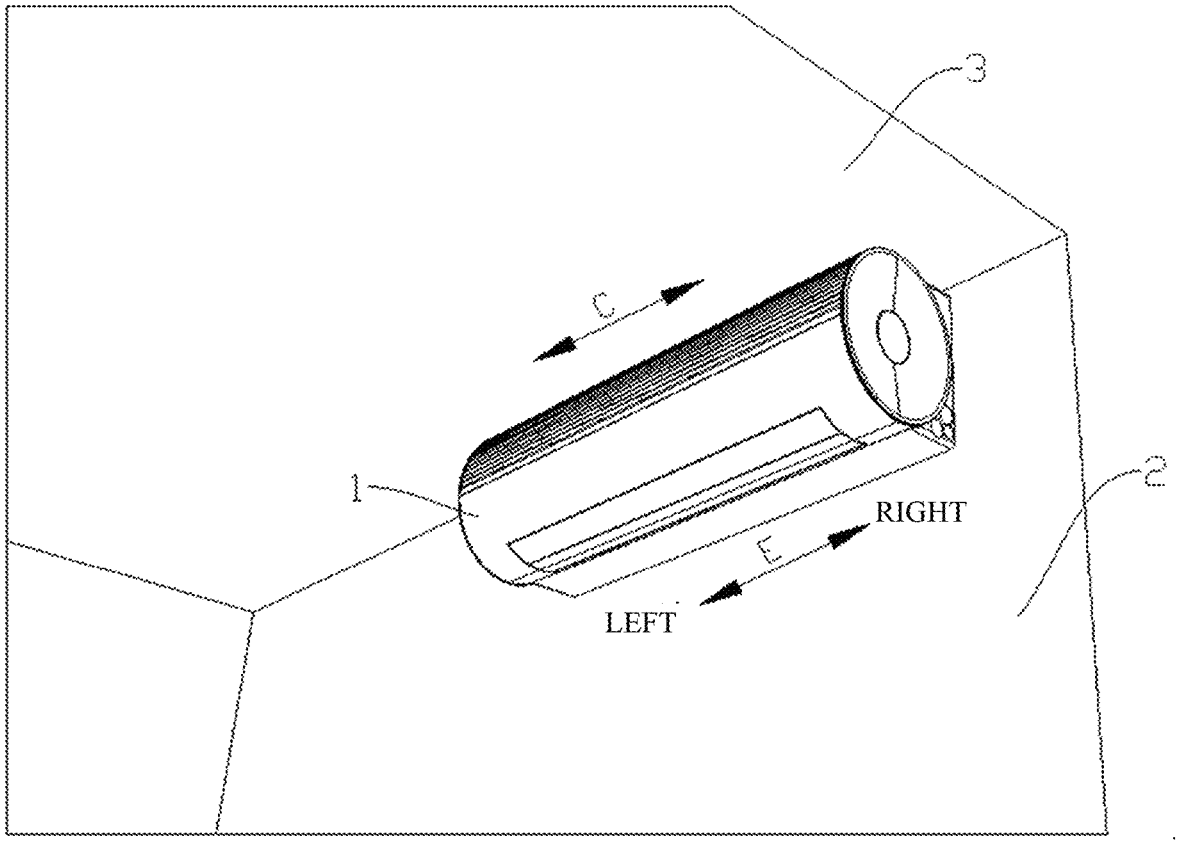
FIG. 3 is a schematic view of a wall-mounted air conditioner according to embodiments of the present disclosure.

As shown in FIGS. 1 and 2, the wall-mounted air conditioner 1 includes the housing 10, the heat exchanger 20, the air duct 30 inside the housing 10, a fan wheel 40 in the air duct 30, and the electric control component 90. The housing 10 includes the front plate 111, and the air inlet 311 is on the front plate 111. The electric control component 90 is mounted in the mounting space 50 defined between the front plate 111 of the housing 10 and the air duct 30.

In some embodiments, when the housing 10 is mounted on the wall surface 2, a distance between a top surface of the housing 10 and the indoor top wall 3 is less than or equal to 20 centimeters. In other words, a minimum distance between the housing 10 and the indoor top wall 3 in the up-down direction is less than or equal to 20 centimeters. Hence, the utilization rate of indoor space can be further improved.

In one embodiment, the distance between the top surface of the housing 10 and the indoor top wall 3 is less than or equal to 15 centimeters. In one embodiment, the distance between the top surface of the housing 10 and the indoor top wall 3 is less than or equal to 10 centimeters. In one embodiment, the distance between the top surface of the housing 10 and the indoor top wall 3 is less than or equal to 8 centimeters. In one embodiment, the distance between the top surface of the housing 10 and the indoor top wall 3 is less than or equal to 5 centimeters. In one embodiment, the top surface of the housing 10 is in contact with the indoor top wall 3, i.e., the distance between the top surface of the housing 10 and the indoor top wall 3 is equal to 0 centimeter. Hence, the utilization rate of indoor space can be further improved.

The air duct 30 includes the air inflow section 313 and the air outflow section 314. The air inflow section 313 forms an inlet air duct 3136, while the air outflow section 314 forms an outlet air duct 3143. The air inlet 311 of the air duct 30 is at an end of the inlet air duct 3136, and the air outlet 312 of the air duct 30 is at an end of the outlet air duct 3143. The heat exchanger 20 is arranged inside the inlet air duct 3136 and at the air inlet 311. The heat exchanger 20 is corresponding to the air inlet 311 to exchange heat with air entering the inlet air duct 3136 from the air inlet 311.

A part of the fan wheel 40 is located in the inlet air duct 3136, and another part of the fan wheel 40 is located in the outlet air duct 3143. The fan wheel 40 is used to generate air exhaust force, allowing air entering the inlet air duct 3136 from the air inlet 311 to subsequently enter the outlet air duct 3143 through the fan wheel 40, and finally be discharged from the air outlet. The arrangement of the fan wheel 40 in the air duct 30 can increase the flow volume and velocity of air passing through the heat exchanger 20, to further improve the heat exchange efficiency of the heat exchanger 20 and the wall-mounted air conditioner 1.

As shown in FIG. 1, the air inflow section 313 obliquely extends forwards and upwards from the air outflow section 314. In other words, the air inflow section 313 obliquely extends forwards and upwards from its connection with the air outflow section 314.

It should be noted that in another embodiments, the air inflow section 313 may also extend horizontally forward from its connection with the air outflow section 314, or the air inflow section 313 may also extend downwards from its connection with the air outflow section 314. In some embodiments, the air inflow section 313 obliquely extends forwards and upwards from its connection with the air outflow section 314 to make the structure of the wall-mounted air conditioner 1 more reasonable.

A part, adjacent to the air outlet 312, of the air outflow section 314 extends downwards and forwards from a remaining part of the air outflow section 314. In other words, the air outflow section 314 includes the part adjacent to the air outlet 312 and the remaining part except for that part. The part, adjacent to the air outlet 312, of the air outflow section 314 extends downwards and forwards from its connection with the remaining part. The air outlet 312 is located at a lower part of the housing 10.

The above arrangement of the air inflow section 313 and the air outflow section 314 causes the air duct 30 to be substantially V-shaped with an opening facing forwards, and the air inflow section 313 is above the part, adjacent to the air outlet 312, of the air outflow section 314. The mounting space 50 is defined among the air inflow section 313, the air outflow section 314, and the front plate 111. The electric control component 90 is mounted in the mounting space 50. It can be understood that the mounting space 50 is located in the front and lower position within the internal space of the housing 10. In other embodiments, the mounting space 50 in the front and lower position within the internal space of the housing 10 may be formed by other means, which will not be limited in the present disclosure.

As shown in FIGS. 1 and 2, in some embodiments, the front plate 111 is a curved plate protruding forwards, and the front plate 111 includes an upper plate portion 1111 and a lower plate portion 1112. The upper plate portion 1111 is an upper portion of the front plate 111, the lower plate portion 1112 is a lower portion of the front plate 111, and the upper plate portion 1111 is above the lower plate portion 1112. The air outlet 312 is on the upper plate portion 1111, and the mounting space 50 is behind the lower plate portion 1112 and below the air outlet 312.

Further, an air duct wall of the air inflow section 313 includes a first air inflow plate 3131 and a second air inflow plate 3132, and the inlet air duct 3136 is formed between the first air inflow plate 3131 and the second air inflow plate 3132. An air duct wall of the air outflow section 314 includes a first air outflow plate 3141 and a second air outflow plate 3142, and the outlet air duct 3143 is formed between the first air outflow plate 3141 and the second air outflow plate 3142. For example, the first air outflow plate 3141 is a volute tongue structure, and the second air outflow plate 3142 is a volute wheel structure.

The mounting space 50 is defined among the second air inflow plate 3132, the second air outflow plate 3142, and the front plate 111. In one embodiment, as shown in FIGS. 1 and 2, the mounting space 50 is defined among a side surface 31321 of the second air inflow plate 3132 away from the inlet air duct 3136, a side surface 31421 of the second air outflow plate 3142 away from the outlet air duct 3143, and a rear surface 1110 of the front plate 111.

In one embodiment, the first air inflow plate 3131 and the first air outflow plate 3141 are connected to form an integrated first wall, while the second air inflow plate 3132 and the second air outflow plate 3142 are connected to form an integrated second wall. The mounting space 50 is defined by the second wall and the front plate 111.

As shown in FIGS. 1 and 2, the heat exchanger 20 is fitted at the air inlet of the air inflow section 313; an upper end of the heat exchanger 20 cooperates with the first air inflow plate 3131, and a first sealing structure (not shown) is provided between the upper end of the heat exchanger 20 and the first air inflow plate 3131; a lower end of the heat exchanger 20 cooperates with the second air inflow plate 3132, and a second sealing structure (not shown) is provided between the lower end of the heat exchanger 20 and the second air inflow plate 3132. The first sealing structure and the second sealing structure are used for sealing to prevent air, which has not undergone heat exchange with the heat exchanger 20, from entering the inlet air duct 3136 via a gap between the heat exchanger 20 and the first air inflow plate 3131 or between the heat exchanger 20 and the second air inflow plate 3132, which may otherwise affect a cooling effect of the air conditioner. In one embodiment, the first sealing structure and the second sealing structure are sealing foam.

Since condensate water is generated during the heat exchange process of the heat exchanger 20, in order to prevent the condensate water from flowing into the outlet air duct 3143 and flowing out from the air outlet 312, the second air inflow plate 3132 includes a sunken part 3133 that forms a water receiving sink 3134 for receiving the condensate water from the heat exchanger 20, as shown in FIGS. 1 and 2. The water receiving sink 3134 is on one side of the sunken part 3133 close to the inlet air duct 3136, and the mounting space 50 is on the other side of the sunken part 3133. For example, the sunken part 3133 is formed in such a way that a part of the second air inflow plate 3132 is recessed in a direction away from the inlet air duct 3136. In one embodiment, the sunken part 3133 may also be seen as a part of the second air inflow plate 3132 protruding into the mounting space 50. The mounting space 50 is on a side of the sunken part 3133 facing away the water receiving sink 3134. Since the sunken part 3133 forms the water receiving sink 3134, the sunken part 3133 may also be called a water receiving tray.

In embodiments shown in FIGS. 1 and 2, the water receiving sink 3134 has an opening facing upwards, and the water receiving sink 3134 has a certain depth in the up-down direction. The water receiving sink 3134 is behind the lower end of the heat exchanger 20, i.e., behind the second sealing structure, and the water receiving sink 3134 is also below the heat exchanger 20 to effectively receive the condensate water of the heat exchanger 20.

Further, a part of the first air inflow plate 3131 is recessed outwards to form an avoidance groove 3135 that is located behind the upper end of the heat exchanger 20, i.e., behind the first sealing structure. The avoidance groove 3135 is used to avoid the condensate water generated by the heat exchanger 20 during the heat exchange process and to prevent the condensate water from flowing into the air outflow section 314 along the first air inflow plate 3131. In one embodiment, a part, adjacent to the air outflow section 314, of the first air inflow plate 3131 is recessed outwards to form the avoidance groove 3135. For example, the avoidance groove 3135 is formed in such a way that a part of the second air inflow plate 3132 is recessed in a direction away from the inlet air duct 3136, and the avoidance groove 3135 may also be seen as a part of the second air inflow plate 3132 protruding outwards.

Further, in some embodiments, the wall-mounted air conditioner 1 also includes a thermal insulation layer 70 located between the electric control component 90 and the air duct 30. In the embodiments shown in FIGS. 1 and 2, the thermal insulation layer 70 is between the second wall and the electric control component 90. That is, the thermal insulation layer 70 is between the electric control component 90 and the second air inflow plate 3132, as well as between the electric control component 90 and the second air outflow plate 3142. The arrangement of the thermal insulation layer 70 can achieve an anti-condensation effect and hence avoid accidents that endanger electric control safety.

As shown in FIGS. 1 and 2, in some embodiments, the electric control component 90 includes a protective shell 91 and an electrical component 92. The protective shell 91 includes a box body 911 and a box cover 912. The box body 911 and the box cover 912 are connected to form a sealed fireproof chamber. The electrical component 92 is in the fireproof chamber. The above arrangement improves the protection ability of the electric control component 90, prevents the electrical component 92 from malfunctioning and catching fire, and enhances the safety factor of the wall-mounted air conditioner 1. In one embodiment, the electric control component 90 can be independently disassembled, greatly improving the convenience for testing and maintenance.

The electrical component 92 includes a mainboard 921 and elements 922. The mainboard 921 is parallel to a bottom plate 913 of the box body 911, and there is a gap between the mainboard and the bottom plate. The elements 922 are mounted on a surface of the mainboard 921 away from the bottom plate 913. In one embodiment, the gap between the mainboard 921 and the bottom plate 913 has a size ranging 4 mm to 15 mm.

Further, in order to adapt to the mounting space 50, as shown in FIGS. 1 and 2, the bottom plate 913 of the box body 911 is obliquely arranged, and a lower end of the bottom plate 913 is behind an upper end of the bottom plate 913. The above arrangement makes the structure of the wall-mounted air conditioner 1 more reasonable. There is an intersection angle θ5 between the bottom plate 913 and the vertical direction, and the intersection angle θ5 is greater than or equal to 0 degree but less than or equal to 90 degrees. A preferred value range of the intersection angle θ5 is greater than or equal to 30 degrees but less than or equal to 60 degrees, in order to make the installation of the electric control component 90 more suitable for the angle of front plate 111 and the shape of the mounting space 50, and make the structure of the wall-mounted air conditioner 1 more reasonable.

As shown in FIGS. 1 and 2, a lower part of the fireproof chamber of the protective shell 91 has a width greater than an upper part thereof. Further, the elements 922 include a first group of elements and a second group of elements. The first group of elements has a height greater than a preset value; the second group of elements has a height less than or equal to the preset value; and the position of the second group of elements is higher than the position of the first group of elements. That is, the elements 922 include some elements 922 (the first group of elements) with a greater height, as well as some elements 922 (the second group of elements) with a smaller height. In some embodiments, in the electric control component 90, the first group of elements with the greater height is mounted below the second group of elements with the smaller height, to make the structure of the electric control component 90 more reasonable.

Additionally, in order to further improve the maintenance efficiency of the electric control component, a maintenance port is provided on the lower plate portion 1112 of the front plate 111, and the maintenance port is covered with a maintenance cover detachably connected to the front plate 111. When it is necessary to repair the electric control component 90, the maintenance cover is removed from the front plate 111 to expose the maintenance port. Maintenance personnel can have access to the electric control component 90 through the maintenance port, without need to remove the entire front plate 111. Hence, the maintenance process is more convenient and efficient.

In some embodiments, a rear surface of the first air inflow plate 3131 and/or the first air outflow plate 3141 is provided with a water tank 60 having an opening facing upwards, and the water tank 60 is arranged obliquely and connected to the water receiving sink 3134. The water tank 60 is used to receive condensate water formed on the rear surface of the first air inflow plate 3131 and/or the first air outflow plate 3141. The water in the water tank 60 will converge into the water receiving sink 3134 and then be discharged together. The oblique arrangement of the water tank 60 means that the water tank 60 is arranged obliquely in its length direction.

In the embodiments shown in FIGS. 1 and 2, the water tank 60 is arranged on a rear surface of the first wall. Further, the water tank 60 is at a rearmost position on the rear surface of the first wall to better receive the condensate water.

As an example, the water tank 60 extends along a length direction of the wall-mounted air conditioner 1 and is obliquely arranged. The water receiving sink 3134 also extends along the length direction of the wall-mounted air conditioner 1 and is obliquely arranged. A tilt direction of the water receiving sink 3134 is the same as a tilt direction of the water tank 60. The length direction of the wall-mounted air conditioner 1 is consistent with a length direction of the air duct 30. The length direction of the air duct 30 is shown by arrow C in FIG. 3. A lower end of the water tank 60 is connected to an upper end of the water receiving sink 3134, and the water in the water tank 60 will converge into the water receiving sink 3134. The lower end of the water receiving sink 3134 is connected to a drainage outlet inside the wall-mounted air conditioner 1, and the water in the water tank 60 and the water receiving sink 3134 can be discharged from the drainage outlet.

As shown in FIGS. 1 and 2, the first air outflow plate 3141 includes a first flat plate portion 3144 adjacent to the air outlet 312, and the second air outflow plate 3142 includes a second flat plate portion 3145 adjacent to the air outlet 312. Inner sides of respective projections of the first flat plate portion 3144 and the second flat plate portion 3145 are both straight lines.

As shown in FIGS. 1 and 2, in a vertical plane perpendicular to the length direction of the air duct 30, a first intersection angle θ1 between the second flat plate portion 3145 and a centerline of the air outflow section 314 is greater than 0 degree and less than or equal to 30 degrees.

It is possible to reduce the space occupied by the outlet air duct 3143 while ensuring the air flow volume inside the outlet air duct 3143 (the air outflow volume of the outlet air duct 3143), and the mounting space 50 is large enough to house the component (the electric control component 90), which is originally mounted on a side (such as a left side and/or a right side) of the air duct 30 in the length direction. The length of the wall-mounted air conditioner 1 can be effectively decreased, and the installation difficulty and space required for the wall-mounted air conditioner 1 can be reduced. A left-right direction is shown by arrow E in FIG. 3.

In one embodiment, the first intersection angle θ1 is greater than or equal to 1 degree and less than or equal to 25 degrees. In one embodiment, the first intersection angle θ1 is greater than or equal to 2 degrees and less than or equal to 20 degrees. In one embodiment, the first intersection angle θ1 is greater than or equal to 3 degrees and less than or equal to 10 degrees. The air flow volume inside the outlet air duct 3143 can be increased, and the capacity of the mounting space 50 can be enlarged, further improving the cooling and heating effect of the wall-mounted air conditioner 1, further decreasing the length of the wall-mounted air conditioner 1, and further reducing the installation difficulty and space required for the wall-mounted air conditioner 1.

In one embodiment, the first intersection angle θ1 may be but is not limited to 1 degree, 2 degrees, 3 degrees, 4 degrees, 5 degrees, 6 degrees, 7 degrees, 8 degrees, 9 degrees, 10 degrees, 15 degrees, 20 degrees, 25 degrees, or 30 degrees.

A second intersection angle θ2 between the first flat plate portion 3144 and the second flat plate portion 3145 is greater than or equal to 5 degrees and less than or equal to 45 degrees. It is possible to reduce the space occupied by the outlet air duct 3143 while ensuring the air flow volume inside the outlet air duct 3143 (the air outflow volume of the outlet air duct 3143), and the mounting space 50 is large enough to house the component (the electric control component 90), which is originally mounted on the side (such as the left side and/or the right side) of the air duct 30 in the length direction. The length of the wall-mounted air conditioner 1 can be effectively decreased, and the installation difficulty and space required for the wall-mounted air conditioner 1 can be reduced.

In one embodiment, the second intersection angle θ2 is greater than or equal to 10 degrees and less than or equal to 40 degrees. In one embodiment, the second intersection angle θ2 is greater than or equal to 10 degrees and less than or equal to 30 degrees. In one embodiment, the second intersection angle θ2 is greater than or equal to 10 degrees and less than or equal to 20 degrees. The air flow volume inside the outlet air duct 3143 can be increased, and the capacity of the mounting space 50 can be enlarged, further improving the cooling and heating effect of the wall-mounted air conditioner 1, further decreasing the length of the wall-mounted air conditioner 1, and further reducing the installation difficulty and space required for the wall-mounted air conditioner 1.

In one embodiment, the second intersection angle θ2 may be but is not limited to 5 degrees, 10 degrees, 11 degrees, 12 degrees, 13 degrees, 14 degrees, 15 degrees, 16 degrees, 17 degrees, 18 degrees, 19 degrees, 20 degrees, 25 degrees, 30 degrees, 35 degrees, 40 degrees, or 45 degrees.

As shown in FIGS. 1 and 2, in the vertical plane perpendicular to the length direction of the air duct 30, a third intersection angle θ3 between a centerline L1 of the air inflow section 313 and a centerline L2 of the air outflow section 314 is greater than or equal to 10 degrees and less than or equal to 85 degrees. It is possible to avoid significant changes in a flow direction of air in the air duct 30, in order to reduce flow resistance against the air and allow the air to flow smoothly in the air duct 30, further improving the cooling and heating effect of the wall-mounted air conditioner 1.

In one embodiment, the third intersection angle θ3 is greater than or equal to 20 degrees and less than or equal to 80 degrees. In one embodiment, the third intersection angle θ3 is greater than or equal to 40 degrees and less than or equal to 75 degrees. In one embodiment, the third intersection angle θ3 is greater than or equal to 60 degrees and less than or equal to 75 degrees. In one embodiment, the third intersection angle θ3 is greater than or equal to 70 degrees and less than or equal to 75 degrees. Consequently, the air can flow more smoothly in the air duct 30 and the cooling and heating effect of the wall-mounted air conditioner 1 can be further improved.

In one embodiment, the third intersection angle θ3 may be but is not limited to 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 71 degrees, 72 degrees, 73 degrees, 74 degrees, 75 degrees, 76 degrees, 77 degrees, 78 degrees, 79 degrees, 80 degrees, or 85 degrees.

As shown in FIGS. 1 and 2, in the vertical plane perpendicular to the length direction of the air duct 30, a fourth intersection angle θ4 between the centerline L2 of the air outflow section 314 and a vertical upward direction is greater than or equal to 120 degrees and less than or equal to 155 degrees. In such a way, the air leaving the outlet air duct 3143 can flow downwards and forwards, that is, the wall-mounted air conditioner 1 can discharge cold air (hot air) downwards and forwards, which can further improve the cooling and heating effect of the wall-mounted air conditioner 1. The vertical upward direction is shown by an upward arrow B in FIG. 1.

In one embodiment, the fourth intersection angle θ4 is greater than or equal to 130 degrees and less than or equal to 150 degrees. In one embodiment, the fourth intersection angle θ4 is greater than or equal to 140 degrees and less than or equal to 145 degrees. The flow direction of the cold air (hot air) discharged from the wall-mounted air conditioner 1 can be further optimized to improve the cooling and heating effect of the wall-mounted air conditioner 1.

In one embodiment, the fourth intersection angle θ4 may be but is not limited to 120 degrees, 125 degrees, 130 degrees, 135 degrees, 140 degrees, 141 degrees, 142 degrees, 143 degrees, 144 degrees, 145 degrees, 150 degrees, or 155 degrees.

In conclusion, in the wall-mounted air conditioner 1 according to the embodiments of the present disclosure, the mounting space 50 is at the front and lower position within the internal space of the housing 10, and the electric control component 90 is mounted in the mounting space 50. Compared to the traditional wall-mounted air conditioner, where the electric control component is mounted on the side of the length direction of the air conditioner's body, the electric control component 90 according to the embodiments of the present disclosure does not occupy the space in the length direction of the air conditioner's body. Under the condition of the same width and height, the wall-mounted air conditioner 1 according to the embodiments of the present disclosure has a shorter body length and a more compact structure. In one embodiment, noise can be reduced while the body length is maintained.

In addition, since the mounting space is located behind the front plate of the housing, the user does not need to remove the entire housing when wiring, disassembling, testing, or repairing the electric control component. Instead, the user only needs to remove the front plate, which greatly improves the convenience for testing and maintenance and enhances operational comfort.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

In addition, terms such as "first" and "second" are used herein for purposes of description and are not intended to indicate or imply relative importance or significance or to imply the number of indicated features. Thus, the feature defined with "first" and "second" may comprise one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communication or interaction of two elements.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Further, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Further, the particular features, structures, materials, or characteristics may be combined in any suitable manner in one or more embodiments or examples.

What is claimed is:

1. A wall-mounted air conditioner, comprising: a housing, an electric control component, and a heat exchanger, wherein:

an air duct is arranged in the housing, the air duct has an air inlet and an air outlet, and the air duct comprises an air inflow section and an air outflow section connected to each other;

at least a part of the air inlet is on a front surface of the housing;

a mounting space is defined between a front plate of the housing and the air duct, and the mounting space is in a front and lower position within an internal space of the housing;

the heat exchanger is in the air duct, and the electric control component is in the mounting space;

the air inlet is on the front plate; the air inflow section extends horizontally or obliquely forwards from the air outflow section; a part, adjacent to the air outlet, of the air outflow section extends downwards and forwards from a remaining part of the air outflow section;

the air inlet extends continuously from the front surface of the housing to a top surface of the housing;

an air duct wall of the air inflow section comprises a first air inflow plate and a second air inflow plate; an air duct wall of the air outflow section comprises a first air outflow plate and a second air outflow plate; and the mounting space is defined among the second air inflow plate, the second air outflow plate and the front plate.

2. The wall-mounted air conditioner according to claim 1, wherein the second air inflow plate comprises a sunken part, and the sunken part forms a water receiving sink for receiving condensate water from the heat exchanger.

3. The wall-mounted air conditioner according to claim 2, wherein the water receiving sink is on a first side of the sunken part, and the mounting space is on a second side of the sunken part.

4. The wall-mounted air conditioner according to claim 1, further comprising a thermal insulation layer between the electric control component and the air duct.

5. The wall-mounted air conditioner according to claim 1, wherein the electric control component comprises:

a protective shell comprising a box body and a box cover, the box body and the box cover being connected to form a sealed fireproof chamber; and an electrical component arranged in the sealed fireproof chamber.

6. The wall-mounted air conditioner according to claim 5, wherein the electrical component comprises a mainboard and elements; the mainboard is parallel to a bottom plate of the box body, and there is a gap between the mainboard and the bottom plate; the elements are mounted on a surface of the mainboard away from the bottom plate.

7. The wall-mounted air conditioner according to claim 6, wherein the front plate is a curved plate protruding forwards and comprises an upper plate portion and a lower plate portion; the air inlet is on the upper plate portion; the mounting space is behind the lower plate portion; the bottom plate is obliquely arranged with a lower end of the bottom plate being behind an upper end of the bottom plate.

8. The wall-mounted air conditioner according to claim 7, wherein the elements comprise a first group of elements and a second group of elements; the first group of elements has a height greater than a preset value; the second group of elements has a height less than or equal to the preset value; and a position of the second group of elements is higher than a position of the first group of elements.

9. The wall-mounted air conditioner according to claim 1, wherein an intersection angle between a centerline of the air inflow section and a centerline of the air outflow section is greater than or equal to 10 degrees and less than or equal to 85 degrees.

10. The wall-mounted air conditioner according to claim 1, wherein a part of the first air inflow plate is recessed outwards to form an avoidance groove located behind upper end of the heat exchanger.

11. The wall-mounted air conditioner according to claim 10, wherein the avoidance groove is configured to prevent a condensate water from flowing into the air outflow section along the first air inflow plate, and configured to facilitate air flow from the air inflow section to the air outflow section.

12. The wall-mounted air conditioner according to claim 1, wherein the first air inflow plate has a bended portion configured to cause the first air inflow plate close to the fan wheel.

* * * * *